United States Patent [19]

Dauphin

[11] Patent Number: 4,966,412

[45] Date of Patent: Oct. 30, 1990

[54] CHAIR, IN PARTICULAR OFFICE CHAIR

[75] Inventor: Elke Dauphin, Offenhausen bei Nürnberg, Fed. Rep. of Germany

[73] Assignee: Burositzmobelfabrik Friedrich-W. Dauphin GmbH & Co., Offenhausen, Fed. Rep. of Germany

[21] Appl. No.: 741,247

[22] Filed: Jun. 4, 1985

[30] Foreign Application Priority Data

Oct. 24, 1984 [DE] Fed. Rep. of Germany ..... 3438843
Mar. 14, 1985 [EP] European Pat. Off. ..... 85102947.0

[51] Int. Cl.[5] ..... A47C 1/032

[52] U.S. Cl. ..... 297/301; 297/316; 297/320

[58] Field of Search ..... 297/300, 301, 316, 320, 297/325, 328, 340

[56] References Cited

U.S. PATENT DOCUMENTS

| | | | |
|---|---|---|---|
| 2,834,402 | 5/1958 | Lautier | 297/320 |
| 2,859,799 | 11/1958 | Moore | 297/316 X |
| 3,603,640 | 9/1971 | Doerner | 297/300 X |
| 4,143,910 | 3/1979 | Geffers et al. | 297/320 X |

FOREIGN PATENT DOCUMENTS

| | | | |
|---|---|---|---|
| 2710043 | 9/1978 | Fed. Rep. of Germany | 297/300 |
| 2843058 | 4/1980 | Fed. Rep. of Germany | 297/316 |
| 3139448 | 4/1983 | Fed. Rep. of Germany | 297/316 |
| 8001534 | 8/1980 | PCT Int'l Appl. | 297/316 |

*Primary Examiner*—Peter R. Brown
*Attorney, Agent, or Firm*—Browdy and Neimark

[57] ABSTRACT

A chair, especially an office chair, has a base and a seat disposed thereon as well as a backrest. The seat and the backrest are supported such that they can be pivoted about horizontal axes in a coordinated manner, and at least one gas spring is provided for damping the pivoting movement and for attaining a restoring action. In such a chair, in order to attain an anatomically appropriate adjustment of the inclination which is perceived by the user as pleasant, and to attain the simplest and most effective possible construction, the chair includes a seat carrier (4) and a backrest support part (7), which is joined to the seat carrier such that it is pivotable about an axis (6), for securing a backrest supporting column (9); a supporting column (2) of the base (1) is rigidly fixable on the seat carrier (4); a seat holder (19) projecting upward beyond the seat carrier (4) and being pivotable thereon is provided on the seat carrier (4); the seat (3), in the vicinity of a front section, is rigidly joined to the seat holder (19); the seat (3), in the vicinity of a section located behind the axis (6), is elastically joined to the backrest support part (7); and a gas spring (33) is disposed between the backrest support part (7) and the seat carrier (4), extending obliquely with respect to the seat (3).

12 Claims, 3 Drawing Sheets

CHAIR, IN PARTICULAR OFFICE CHAIR

FIELD OF THE INVENTION

The invention relates to a chair, in particular an office chair, generally having a base, a seat disposed on it, and a backrest. The seat and the backrest are supported such that they pivot about horizontal axes in a coordinated manner in accordance with the weight shifts of a person using the chair; at least one gas spring is provided in order to damp the pivoting movement and to attain a restoring effect.

BACKGROUND OF THE INVENTION

In a chair of this kind, a mechanism is provided which assures that when the user shifts his weight, for instance when leaning back in the chair, an anatomically adapted shift in the relative inclination of the seat surface and the backrest is effected in a coordinated manner. Such mechanisms are therefore known as synchronizing mechanisms.

A chair of this general type, provided with this kind of synchronizing mechanism, is known from German patent document A 27 57 349. However, like other comparable chairs known previously (see, for instance, German patent documents C 27 33 322 and C 28 36 216 which correspond to U.S. Pat. No. 4,200,332), this chair has the disadvantage that because of the relative movement in shifting the inclination of the seat and the backrest, a pull is exerted on the clothes of the user, which is perceived as unpleasant. This is due, among other factors, to the fact that in the previously known construction, an adjusting device is supported on the supporting column of the chair base such that it is pivotable about a horizontal axis, with the pivoting movement of the seat and backrest being coordinated via a triangular swinging arm. The posterior end of the seat is connected via a toggle joint to the lower end of the backrest support column, and this articulation point of the toggle joint is connected to the lower articulation point of the triangular swinging arm via a gas spring. This means that the backrest support column, in the final analysis, is pivotably joined to a section of the seat via a parallelogram linkage embodied by the triangular swinging arm, the toggle joint, the gas spring and this section of the seat. A further parallelogram linkage is embodied between the triangular swinging arm and a toggle joint which with one end engages the vicinity of the front edge of the seat and the other end of which is joined to a further gas spring.

The known embodiment has not only the inherent disadvantage of a pushing or pulling effect on the user's clothes but also has the disadvantage that in order to attain a damping effect on the inclination shifting movement on the one hand and to attain a sufficiently great restoring moment on the other, two springs that are independent of one another must be provided, which makes construction relatively complicated and increases the cost of manufacture.

SUMMARY OF THE INVENTION

It is accordingly an object of the present invention to embody a chair of the general type described above in such a way that a synchronized movement which is properly adapted anatomically nd is perceived as pleasant by the user is attained between the backrest and the seat when the user shifts his weight, and such that the chair, intermsof its construction, functions reliably and can be manufactured at a favorable cost.

This object is attained in accordance with the inventioon by providing a chair including a seat carier and a backrest support part, which is joined to theseat carrier such that it is poivotable about an axis, for securing a backrest supporting column; a supporting column of the base is rigidly fixable on the seat carrier; a seat holder projecting upward beyond the seat carrier and being pivotable thereon is provided on the sat carrier; the seat, in the vicinity of a front section, is rigidly joined to the seat holder; the seat, in the vicinity of a section located behind the axis is elastically joined to the backrest support part; and a gas spring is disposed between the backrest support part and the seat carrier, extending obliquely with respect to the seat.

As a result of the associatino of the individual structural jparts with one another as provided by the invention, the user's clothing is not subjected to undersirable pushign and pulling, since the downward movement of the backrest does not lag behind the downward movement of the end of the seat; quite the contrary, the distance between the upper edge of the seat and the lower edge of the back rest in fact decreases. It is also possible in accordance with the invention to provide only a single gas spring, which both damps the inclination movement and also exerts the necessary restoring moments for restoring the backrest whenever the user again shifts his weight forward.

The elastic buffers, of rubber or the like, provided by the invention act on the one hand as resilient spacers between the rear section of the seat and the supporting part of the backrest, and on the other hand enable a complicated relative movement between the seat and the backrest portion, which because of the construction according to the invention is imposed on the backrest part when the user leans back. At this time, not only does the distance between the seat and the backrest support part vary, but a translational movement of the parts approximately parallel to one another takes place as well.

Preferably the pivot axis between the backrest support part and seat carrier is disposed approximately in the middle between the front end of the seat carrier and the rear end of the backrest support part; then the course of movement can be influenced by means of the precise location of the pivot axis.

The construction according to the invention makes it possible in principle for merely one gas spring to suffice. Disposing the gas spring so that one of its articulation axes is disposed on the seat carrier below the pivot axis of the backrest support to seat carrier, and spaced from the seat carrier, and so that the other of its articulation axes is disposed on the backrest support in the vicinity of its upper and back edges, assures that in a particularly advantageous manner, a sole gas spring such as this becomes effective both for damping the tilting movements and for the restoring movements.

It is particularly advantageous if the distance between the pivot axis of the seat holder and the pivot axis between the seat carrier and backrest support part is at a ratio of approximately 2:1 to the distance between the pivot axis and the articulation axis of the gas spring on the seat carrier; and/or if the angle of inclination of the gas spring with respect to the seat is approximately 30 to 45°.

By embodying the seat carrier and the backrest support part with a U-shaped cross section, with the side walls of the backrest support part overlapping the side walls of the seat carrier at intervals, bearings are provided in a simple manner for the pivot shafts that are required. Furthermore, the functional interlocking of these parts becomes unproblematic; a high degree of static stability is attained; and finally this construction also pays appropriate attention to esthetic considerations.

The pivot shafts are particularly simple if the pivot axis between the backrest support part and the seat carrier is embodied by a bolt passing through the side walls, and the articulation axis of the gas spring on the seat carrier is embodied by a bolt secured to its side walls and the articulation axis of the gas spring on the backrest support part is embodied by a bolt passing through its side walls.

Providing gas springs used in office chairs with a locking device is known per se. However, when the gas spring is disposed as provided by the invention, the locking device according to the invention can be embodied particularly simply and effectively, especially in the form of a relatively inexpensive, purely mechanical locking device.

Further characteristics, advantages and details of the invention will become apparent from the ensuing description of a preferred form of embodiment, taken in conjunction with the drawings.

DESCRIPTION OF THE PREFERRED EMBODIMENT

Figure 1:
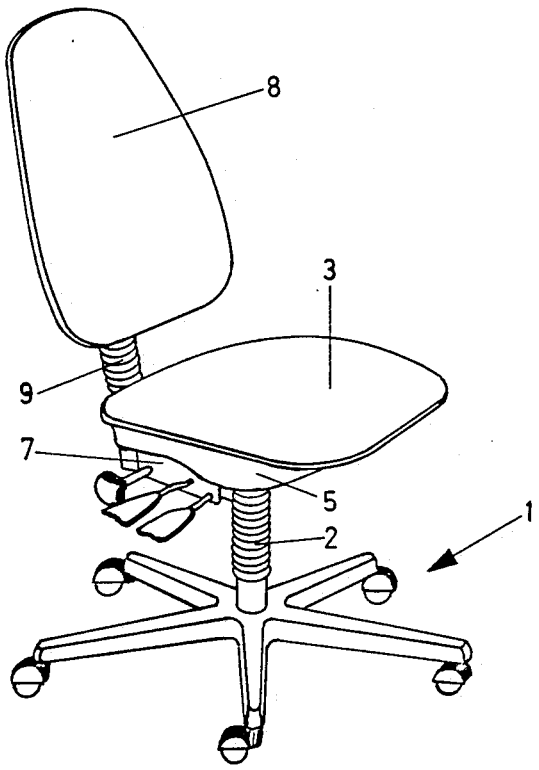
FIG. 1 is a schematic side view of an office chair.

An office chair shown in FIG. 1 includes a base 1 having a supporting column 2, which is joined to a seat carrier 4 receiving the cushioned seat 3. In FIG. 1, only the outer covering 5 of the seat carrier 4 is shown.

A backrest support part 7 is connected to the seat carrier 4 such that it is pivotable about a pivot axis 6, and the backrest supporting column 9 that supports the backrest 8 is connected to the backrest support part 7.

The seat 3 is connected in an articulated manner, not shown in detail in the drawing, to the front end of the seat carrier 4 on the one hand and to the backrest support part 7 on the other. The articulated connection between the seat carrier 4 and the backrest support part 7 is furnished by means of a pivot bolt 10, which passes through the side walls 11, 12 and 13, 14 of the backrest support part 7 and the seat carrier 4. Each of the seat carrier 4 and one backrest support 7 has a U-shaped cross section, of which the transverse parts 15, 16 of the U point toward the top, that is, toward the seat, and the side walls 11, 12 of the backrest support part 7 partially overlap the side walls 13, 14 of the seat carrier 4.

At the front end of the seat carrier 4, a seat holder 19 is pivotably supported by means of a pivot bolt 18, which defines a pivot axis. The seat holder 29 has a substantially L-shaped profile 20 having a bearing box 21 receiving the pivot bolt 18 and spacers 22 to which the seat 3 is rigidly secured.

A cone 23 for receiving the supporting column 2 is rigidly secured to the seat carrier 4, and an actuating lever 25 for adjusting the height of the seat, by means of a corresponding device not shown in detail, passes through a recess 24 in the vicinity of the cone 23.

Beginning at an angled edge 26 (See FIG. 3), the backrest support part 7 tapers toward the back, where a guide element 27 for the backrest supporting column 9 is welded in place. A clamping screw 28 having an actuating lever 29 engages a bore 30 of the guide element 27, thereby making it possible to clamp the arms of the guide element 27, which is U-shaped in this embodiment, so as to fix the backrest supporting column in position. Two rubber buffers 32 (see FIG. 2) are secured at one end to the transverse part 15 of the U of the backrest support part 7 and at the other to the rigid seat bottom 31 of the seat 3.

A gas spring 33 is articulated at one end on a pivot bolt 34 which extends through bores 35 in the side walls 11, 12 of the backrest support part 7 and at the other end on a pivot bolt 36, which extends through a bore 37 of the side walls 13, 14.

The side wall 11 of the backrest support part 7 has a slit 39 extending in the form of a section of a circle, through which an actuating lever 40 for a locking device 38 passes so as to engage the slit.

If the seat 3 is urged in the direction of the arrow 41 (see FIG. 2), or the backrest 8 is urged in the direction of the arrow 42, when a user shifts his weight backward, then the backrest support part 7 is pivoted about the pivot axis 6 counter to the spring force of the gas spring 33 about an angle $\gamma$ until a state of equilibrium is attained. At the same time, the seat holder 19 connected to the seat 3 is pivoted about the pivot axis 18 by the angle $\beta$. Because the rubber buffer 32 joining the seat 3 and the backrest support part 7 is spaced farther from the pivot axis 18 of the seat 3 than from the pivot axis 6 of the backrest support part 7, the angle $\gamma$ is larger than the angle $\beta$.

Figure 2:
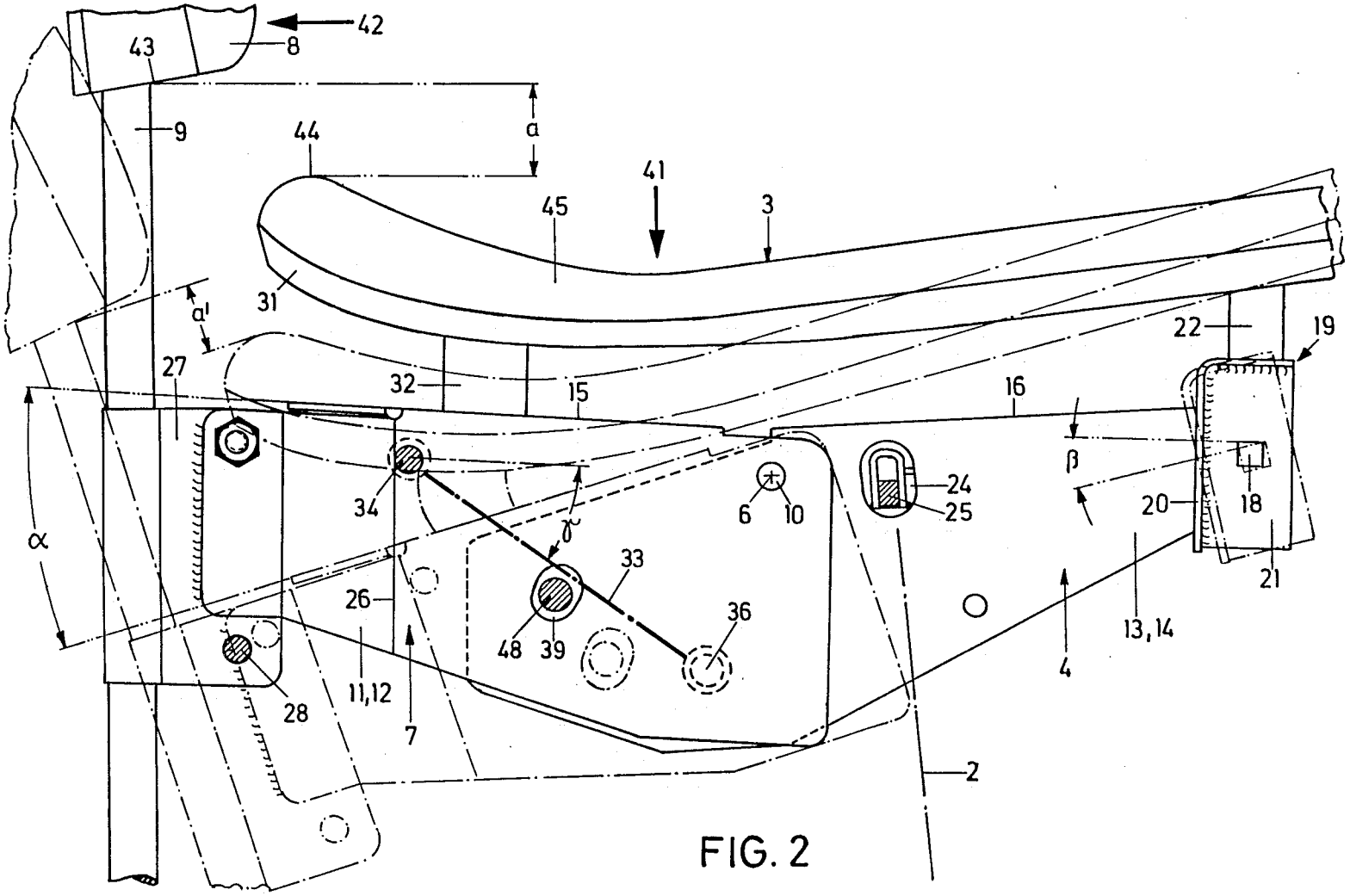
FIG. 2 is a schematic side view of the essential elements of the construction according to the invention in two different inclined positions.
Figure 3:
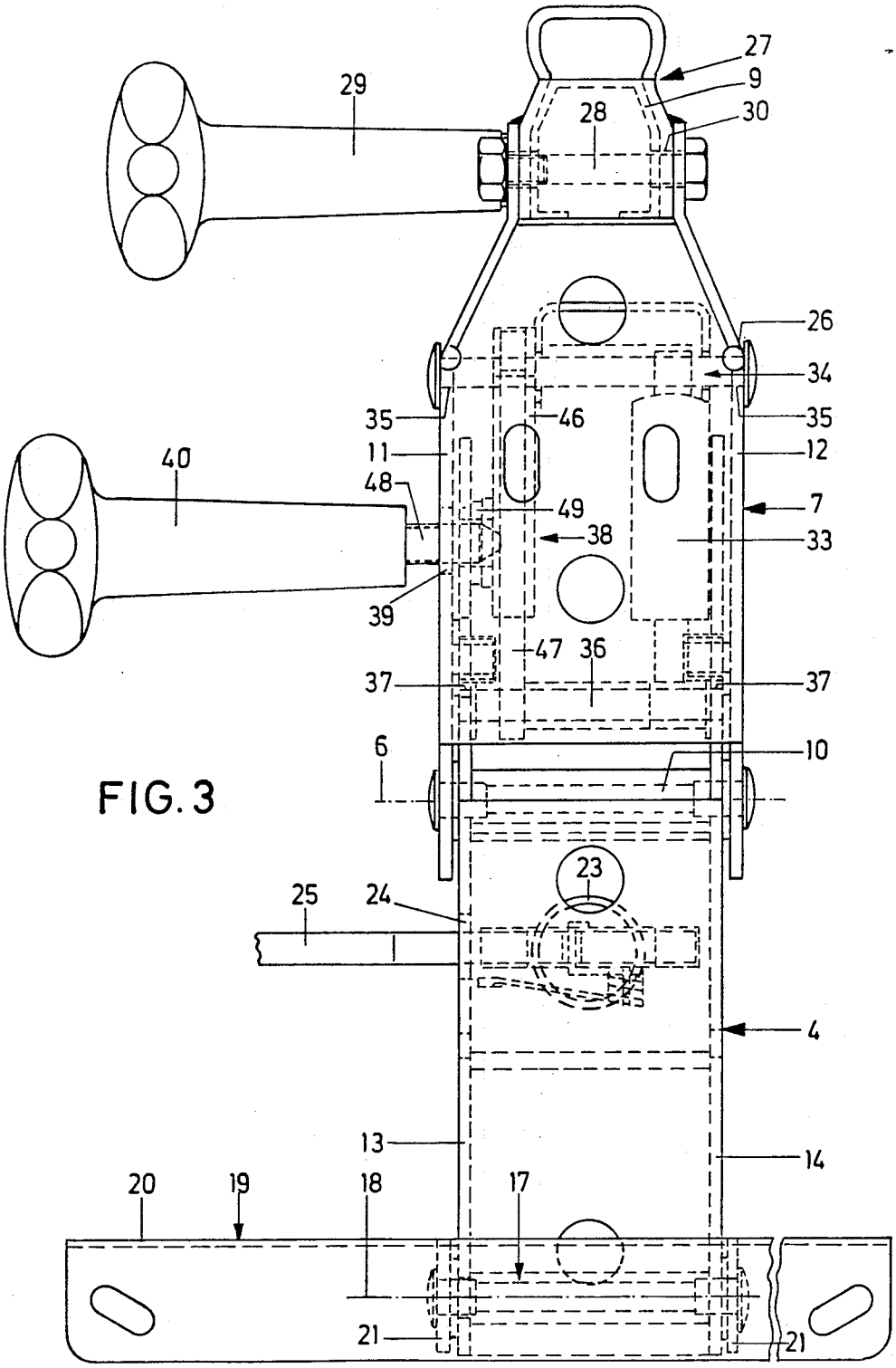
FIG. 3 is a view from above of the backrest support part and the seat carrier.

As a result of this movement of the user, the backrest 8 and the seat 3 move out of the position shown in solid lines in FIG. 2 and assume the position shown in broken lines in FIG. 2. During this pivoting movement, the distance a between the lower edge 43 of the backrest 8 and the upper edge 44 of the cushion 43 of the seat 3 varies in such a manner that the corresponding new distance a' is smaller than the original distance; that is, in contrast to previously known constructions, the original distance a is not increased, and accordingly no tension is exerted upon the user's clothing.

If the user shifts his weight forward again, this does not as a rule suffice to assure that the backrest 8 will at each moment remain reliably in contact with the user's back. This return movement of the backrest 8 is assured in this phase, however, by the gas spring 33, which has engagement points on the backrest support part 7, on the one hand, and the seat carrier 4 on the other, such that a reliable return of the backrest 8 even from a severely backward-pivoted position to the original position is assured without requiring further springs.

The above advantages which are attainable in principle as a result of the embodiment according to the invention are optimized by dimensioning the chair as follows:

The pivot axis 6 is disposed approximately in the middle between the pivot axis 18 and the pivot axis 34, which is embodied by the pivot bolt 35.

The distance between the lower articulation axis (pivot bolt 36) of the gas spring 33 and the pivot axis 6 is approximately half as long as the distance between the pivot axis 6 and the pivot axis 18.

The angle $\gamma$ between the longitudinal axis of the gas spring 33 and the transverse part 15 of the U of the backrest support part 7 is approximately 30°.

The distance between the rubber buffers 32 and the pivot axis 18 is approximately 2½ times as long as the distance between them and the pivot axis 6.

The locking device 38 can be particularly simply embodied, in the context of the construction according to the invention, by providing that it includes a sheath part 46 and a piston part 47, the piston part being disposed such that it is longitudinally displaceable in the sheath part. This device is disposed parallel to the gas spring 33; that is, the sheath part 46 is pivotably supported on the bolt 34 and the piston part 47 is pivotably supported on the bolt 36. On its free end, the actuating lever 40 has a threaded bolt 48 which passes through a threaded sheath 49, which is joined to the side wall 13 of the seat carrier 4. When the actuating lever 40 is tightened, the front end of the threaded bolt 48 presses against the telescoped piston and sheath parts 46 and 47 and clamps them together over a large surface area. Thus, despite the ease of manipulation, a high degree of surface pressure and thus reliable locking are attained, so that the seat 4 and backrest can be pivoted upon demand.

It is to be understood that the present invention is not limited to the embodiments disclosed which are illustratively offered and that modifications may be made without departing from the invention.

What is claimed is:

1. A chair, in particular an office chair, having a base and a seat disposed thereon as well as a backrest, wherein the seat and the backrest are supported such that they are pivotable in a coordinated manner about horizontal axes in accordance with the shift in weight of a user, and wherein at least one gas spring is provided for damping the pivoting movement and for attaining a restoring action, said chair comprising:

a seat carrier (4), and a backrest support part (7) for securing a backrest supporting column (9) which is joined to the seat carrier such that it is pivotable about a first axis (6);

a supporting column (2), supported on the base (1), and being rigidly fixable on, but removable from, the seat carrier (4), said seat carrier (4) extending parallel to the seat and comprising an inner rear end and an outer front end;

a seat holder (19) projecting upwardly beyond the seat carrier (4) and being pivotable thereon about a pivot axis (18) provided on the seat carrier (4);

the seat (3), in the vicinity of a front section thereof, being rigidly joined to the seat holder (19);

the seat (3), in the vicinity of a section located behind the first axis (6), being elastically joined to the backrest support part by elastic buffers (32);

said gas spring (33) being disposed between the backrest support part (7) and the seat carrier (4), said gas spring extending obliquely with respect to the seat (3), and having one end supported on a first articulation shaft (36) and the opposite end supported on a second articulation shaft (34);

the first articulation shaft (36) for the gas spring (33) being disposed on the seat carrier (4) below the first axis (6) between the backrest support part (7) and the seat carrier (4) spaced apart from a corner of the seat, the second articulation shaft (34) of the gas spring (33) being disposed on the backrest support part (7) in the vicinity of the upper edge and the rear edge thereof; and the distance between the pivot axis (18) of the seat holder (19) and the pivot axis (6) between the seat carrier (4) and backrest support part(7) being at a ratio of approximately 2:1 to the distance between he pivot axis (6) and the articulation axis (36) of the gas spring (33) on the seat carrier (4).

2. A chair as defined by claim 1, characterized in that associated with the gas spring (33)is a locking device (38)having an actuating lever (40).

3. A chair, in particular an office chair, having a base and a seat disposed thereon as well as a brackrest, wherein the seat and the backrest are supported such that they are pivotable in a coordinated manner about horizontal axes in accordance with the shift in weight of a user, and wherein at least one gas spring is provided for damping the pivoting movement and for attaining a restoring action, said chair comprising:

a seat carrier (4), and a backrest support part (7) for securing a backrest supporting column (9) which is joined to the seat carrier such that it is pivotable about a first axis (6);

a supporting column (2), supported on the base (1), and being rigidly fixable on, but removable from, the seat carrier (4), said seat carrier (4) extending parallel to he seat and comprising an inner rear end and an outer front end;

a seat holder (19) projecting upwardly beyond the seat carrier (4) and being pivotable thereon about a pivot axis (18) provided on the seat carrier (4);

the seat (3), in the vicinity of a front section thereof, being rigidly joined to the seat holder (19);

the seat (3), in the vicinity of a section located behind the first axis (6), being elastically joined to the backrest support part by elastic buffers (32);

said gas spring (33) being disposed between the backrest support part (7) and the seat carrier (4), said gas spring extending obliquely with respect to the seat (3), and having one end supported on a first articulation shaft (36) and the opposite end supported on a second articulation shaft (34);

the first articulation shaft (36) for the gas spring (33) being disposed on the seat carrier (4) below the first axis (6) between the backrest support part (7) and the seat carrier (4) spaced apart from a corner of the seat, the second articulation shaft (34) of the gas spring (33) being disposed on the backrest support part (7) in the vicinity of the upper edge and the rear edge thereof; and the angle of inclination ( ) of the gas spring (33) with respect to the seat (3) being approximately 30 to 45°.

4. A chair as defined by claim 3, characterized in that the seat carrier (4) and the backrest support part (7) are U-shaped in cross section, and the side walls (11, 12) of the backrest support part (7) intermittently overlap those of the seat carrier (4).

5. A chair as defined by claim 4, characterized in that the pivot axis (6) between the backrest support pat (7) and the seat carrier (4) is embodied by a bolt (10) passing through the side walls (11, 12), and the articulation axis (6) of the gas spring (33) on the seat carrier (4) is embodied by a bolt (36) secured to its side walls (13, 14), and the articulation axis of the gas spring (33) on the backrest support part (7) is embodied by a bolt (34) passing through its side walls (11, 12).

6. A chair, in particular an office chair, having a base and a seat disposed thereon as well as a backrest, wherein the seat and the backrest are supported such that they are pivotable in a coordinated manner about horizontal axes in accordance with the shift in weight of a user, and wherein at least one gas spring is provided for damping the pivoting movement and for attaining a restoring action, said chair comprising:

a seat carrier (4), and a backrest support part (7) for securing a backrest supporting column (9) which is joined to the seat carrier such that it is pivotable about a first axis (6);

a supporting column (2), supported on the base (1) and being rigidly fixable on, but removable from, the seat carrier (4), said seat carrier (4) extending parallel to the seat and comprising an inner rear end and an outer front end;

a seat holder (19) projecting upwardly beyond the seat carrier (4)and being pivotable thereon about a pivot axis (18) provided on the seat carrier (4);

the seat (3), in the vicinity of a front section thereof, being rigidly joined to the seat holder (19);

the seat (3), in the vicinity of a section located behind the first axis (6), being elastically joined to the backrest support part by elastic buffers (32);

said gas spring (33) being disposed between the backrest support part (7) and the seat carrier (4), said gas spring extending obliquely with respect to the seat (3), and having one end supported on a first articulation shaft (36) and the opposite end supported on a second articulation shaft (34);

the first articulation shaft (36) for the gas spring (33) being disposed on the seat carrier (4) below the first axis (6) between the backrest support part (7) and the seat carrier (4) spaced apart from a corner of the seat, the second articulation shaft (34) of the gas spring (33) being disposed on the backrest support part (7) in the vicinity of the upper edge nd the rear edge thereof; and a locking device (38) having an actuating lever (40), said locking device (38) having a sheath part and a piston part (46 and 47, respectively), which are disposed parallel to the gas spring (33), said sheath part and piston part telescoping within one another and being clampable together over a relatively large surface area for locking purposes by means of the actuating lever (40).

7. A chair, in particular office chair, having a base and a seat disposed thereon as well as a backrest, wherein the seat and the backrest are supported such that they are pivotable in coordinated manner about horizontal axes in accordance with the shift in weight of a user, and wherein at least one gas spring is provided for damping the pivoting movement and for attaining a restoring action, said chair comprising:

a seat carrier (4), and a backrest support part (7) for securing a backrest supporting column (9) which is joined to the seat carrier such that it is pivotable about a first axis (6);

a supporting column (2) supported on the base (1) and being rigidly fixable on, but removable from, the seat carrier (4), said seat carrier (4) extending parallel to the seat and comprising an inner rear end and an outer front end;

a seat holder (19) projecting upward beyond the seat carrier (4) and being pivotable thereon provided on the seat carrier (4);

the seat (3), in the vicinity of a front section thereof, being rigidly joined to the seat holder (19);

the seat (3), in the vicinity of a section located behind the first axis (6), being elastically joined to the backrest support part by elastic buffers (32);

a gas spring(33) disposed between the backrest support part (7) and the seat carrier (4), said gas spring extending obliquely with respect to the seat (3) and having one end supported on a firs articulation shaft (36) and the opposite end supported on a second articulation shaft (34);

the first articulation shaft (36) for the gas spring (33) being disposed on the seat carrier (4) below the first axis (6) between the backrest support part (7) and the seat carrier (4) spaced apart from a corner of the seat, the second articulation shaft (34) of the gas spring (33) being disposed on the backrest support part (7) in the vicinity of the upper edge and the rear edge thereof, said first axis (6) between the backrest support part (7) and the seat carrier (4) being disposed approximately midway between the outer front end of the seat carrier (4) and the inner rear end of the backrest support part (7); and the distance between the pivot axis 918) of the seat holder (19) and the pivot axis (6) between the seat carrier (4) and backrest support part (7) being at a ratio of approximately 2:1 to the distance between the pivot axis (6) and the articulation axis (36) of the gas spring (33) on the seat carrier (4).

8. A chair, in particular office chair, having a base and a seat disposed thereon as well as a backrest, wherein the seat and the backrest are supported such that they are pivotable in coordinated manner about horizontal axes in accordance with the shift in weight of a user, and wherein at least one gas spring is provided for damping the pivoting movement and for attaining a restoring action, said chair comprising:

a seat carrier (4), and a backrest support part (7) for securing a backrest supporting column (9) which is joined to the seat carrier such that it is pivotable about a first axis (6);

a supporting column (2) supported on the base (1) and being rigidly fixable on, but removable from, the seat carrier (4), said seat carrier (4)extending parallel to the seat and comprising an inner rear end and an outer front end;

a seat holder (19) projecting upward beyond the seat carrier (4) and being pivotable thereon provided on the seat carrier (4);

the seat (3), in the vicinity of a front section thereof, being rigidly joined to the seat holder (19);

the seat (3), in the vicinity of a section located behind the first axis (6), being elastically joined to the backrest support part by elastic buffers (32);

a gas spring (33) disposed between the backrest support part (7) and the seat carrier (4), said gas spring extending obliquely with respect to the seat (3) and having one end supported on a first articulation shaft (36) and the opposite end supported on a second articulation shaft (34);

the first articulation shaft (36) for the gas spring (33) being disposed on the seat carrier (4) below the first axis (6) between the backrest support part (7) and the seat carrier (4) spaced apart from a corner of the seat, the second articulation shaft (34) of the gas spring (33) being disposed on the backrest support part (7) in the vicinity of the upper edge and the rear edge thereof, said first axis (6) between the backrest support part (7) and the seat carrier (4) being disposed approximately midway between the outer front end of the seat carrier (4) and the inner rear end of the backrest support part (7); and the articulation shaft (36) for the gas spring(33) being disposed on the seat carrier (4) below the pivot axis (6) between the backrest support part (7) and the seat carrier (4) spaced apart from the seat carrier, and the articulation shaft (34) of the gas spring (33) being disposed on the backrest support part (7) in the vicinity of the upper edge and the rear edge thereof, the distance between the pivot axis (18) of the seat holder (19) and the pivot axis (6) between the seat carrier (4) and the backrest support part (7) being at a ratio of approximately 2:1 to the distance between the pivot axis (6) and the articulation axis (36) of the gas spring(33) on the seat carrier (4).

9. A chair as defined by claim 8, characterized in that the angle of inclination ($\gamma$) of the gas spring (33) with respect to the seat (3) is approximately 30 to 45°.

10. A chair as defined by claim 9, characterized in that the seat carrier (4) and the backrest support part (7) are U-shaped in cross section, and the side walls (11, 12) of the backrest support part (7) intermittently overlap those of the seat carrier (4).

11. A chair as defined by claim 10, characterized in that he pivot axis (6) between the backrest support part (7) and the seat carrier (4) is embodied by a bolt (10) passing through the side walls (11, 12), and the articulating axis (6) of the gas spring (33) on the seat carrier (4) is embodied by a bolt (36) secured to its side walls (13, 14), and the articulation axis of the gas spring (33) on the backrest support part (7) is embodied by a volt (34) passing through its side walls (11, 12).

12. A chair as defined by claim 11, characterized in that associated with the gas spring (33) is a locking device (38) having an actuating lever (40).

* * * * *